United States Patent [19]

MacLeod

[11] Patent Number: 4,723,711

[45] Date of Patent: Feb. 9, 1988

[54] FAUCET AERATOR COLLAR FOR PROTECTING DISHES AND THE LIKE

[76] Inventor: Norman J. MacLeod, 26 Nicole Ave., West Yarmouth, Mass. 02673

[21] Appl. No.: 888,758

[22] Filed: Jul. 23, 1986

Related U.S. Application Data

[63] Continuation-in-part of Ser. No. 698,236, Feb. 5, 1985, abandoned.

[51] Int. Cl.[4] ..... B05B 15/00

[52] U.S. Cl. ..... 239/288.3; 239/428.5

[58] Field of Search ..... 239/602, 546, 288–288.5, 239/428.5; 23/DIG. 36; 137/379

[56] References Cited

U.S. PATENT DOCUMENTS

| | | | |
|---|---|---|---|
| 1,992,490 | 2/1935 | Louis | 239/602 X |
| 2,100,165 | 11/1937 | Holmberg et al. | 239/428.5 |
| 3,211,196 | 10/1965 | Rozinak | 239/288.5 X |
| 3,232,541 | 2/1960 | Aghnides | 239/602 X |
| 3,348,777 | 10/1967 | Hjulian | 239/428.5 X |
| 4,232,825 | 11/1980 | Berry | 239/428.5 X |

FOREIGN PATENT DOCUMENTS

| | | | |
|---|---|---|---|
| 2357257 | 5/1975 | Fed. Rep. of Germany | 239/288.3 |

*Primary Examiner*—Andres Kashnikow
*Assistant Examiner*—Kevin Patrick Weldon
*Attorney, Agent, or Firm*—V. L. Leon; Harry I. Leon

[57] ABSTRACT

A protective collar entirely of a resilient, cushioning material such as a thermoplastic rubber and having the shape of an annular ring which has an open end which may be sleeved over an aerator mounted at the tip of a faucet spout. The discharge end of the collar has an aperture formed therein with a diameter greater than that of the discharge outlet of the aerator so that the collar does not interfere with the flow of water through the aerator. At the same time, the diameter of this aperture is less than that of the leading edge of the aerator so that the collar, when in position for use, abuts this edge, thereby protecting fragile and easily chipped objects impacting upon either the underside of the aerator or upon its vertical sides.

3 Claims, 6 Drawing Figures

Fig. 1.
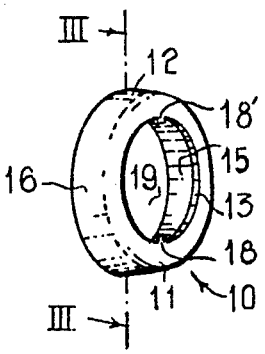
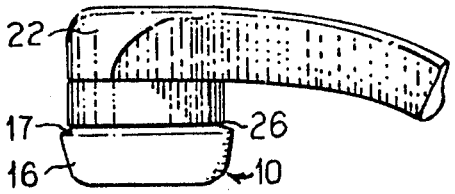
Fig. 2.
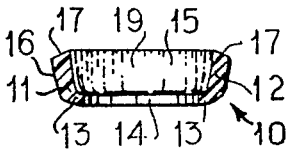
Fig. 3.
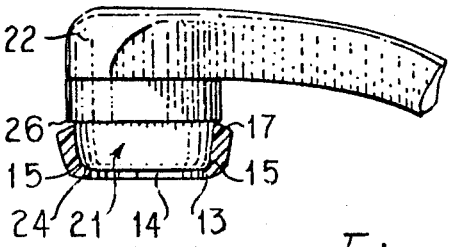
Fig. 4.
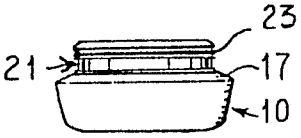
Fig. 6.
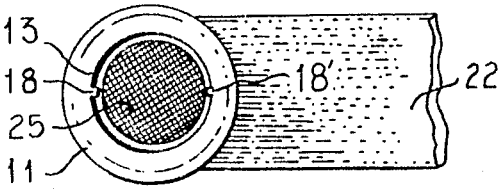
Fig. 5.

FAUCET AERATOR COLLAR FOR PROTECTING DISHES AND THE LIKE

CROSS-REFERENCE TO RELATED APPLICATION

This application is a continuation-in-part of my earlier copending application, Ser. No. 698,236, filed Feb. 5, 1985 abandoned.

BACKGROUND OF THE INVENTION

1. Field of the Invention

This invention relates generally to a cover for an individual water fixture which overhangs a kitchen or bathroom sink or the like and particularly to a cover for a faucet aerator mounted on the tip of the spout of such a fixture, the cover constituting a cushion to protect fragile objects which may impact upon the aerator.

2. Description of the Prior Art

Devices which can be held on a faucet aerator to protect fragile objects impacting thereon have been described in U.S. Pat. No. 3,129,894.

In the device according to the named patent, there is provided an elongated body of elastic rubber which terminates in a narrow outlet slit. The elongated body must be pulled onto the spout by the use of a reinforcing ring adjacent the inner end of this body and by the use of a flanged finger piece proximate the discharge end thereof. Friction forces between the elongated body and the surface of the spout are utilized to maintain the device in position when water is flowing through the narrow slit; these forces must be overcome when the body is being positioned on the spout. This task is especially difficult when one attempts to pull the elongated body onto the spout until the narrow slit is itself forced over and past the edge of the faucet spout. Further, such a configuration, while permitting an unrestricted discharge from the faucet spout, does not protect objects impacting upon the exposed leading edge of the spout.

SUMMARY OF THE INVENTION

In the subject invention, there is provided a collar having a short annular body of elastic material which is readily slipped onto a faucet aerator mounted at the tip of a spout. The inner side wall of the collar is adapted for frictional gripping against a portion of the outer surface of the aerator. The discharge end of the collar has a lip which extends inwardly a sufficient distance to cover the leading edge of the aerator but not so far as to overlay any part of a screened opening in the discharge outlet of the aerator, so that when the collar is in position for use, it protects fragile and easily chipped objects impacting upon either the leading edge of the aerator or upon the vertical sides thereof and at the same time does not interfere with the flow of water therethrough.

When the collar is in position for use, the edge of the collar distal the lip extends only to points on the aerator which are disposed contiguous the tip of the spout on which the aerator is mounted. To enhance the ability of the collar to grip the outer surface of the aerator, the lower portion of the inner side wall of the collar is directed generally inward, having a gradual taper towards the lip in the region proximate to and bounded by the juncture of the lip with the inner side wall. This taper complements that of the outer surface of the aerator which slopes slightly inward towards the edge of its discharge outlet, thereby providing a close fit between the aerator and the inner side wall of the collar.

BRIEF DESCRIPTION OF THE DRAWINGS

Further details are explained below with the help of the examples illustrated in the attached drawings in which:

FIG. 1 is a perspective view of one embodiment of the present invention;

FIG. 2 is an elevational view of the embodiment shown in FIG. 1 in which it is mounted in operational position on an aerator attached to the end of a faucet spout, the spout being shown in a fragmentary view;

FIG. 3 is a cross-section III—III from FIG. 1;

FIG. 4 is a cross-sectional elevational view of the embodiment shown in FIG. 1 and positioned as illustrated in FIG. 2;

FIG. 5 is a bottom plan view of the embodiment shown in FIG. 1 and positioned as illustrated in FIG. 2; and FIG. 6 is an elevational view of the embodiment shown in FIG. 1 mounted on an aerator, the threads of which have been disengaged from those of a faucet spout.

DESCRIPTION OF THE PREFERRED EMBODIMENT

In the drawings, a device 10 in accordance with the present invention is shown positioned on a faucet aerator 21 at the tip of a spout 22. Typically, such an aerator is secured to the spout by engaging threads 23 formed on the inlet section of the aerator with threads (not shown) in the end of the spout (see FIGS. 2, 4–6).

As illustrated in the drawings, the device 10 comprises an annular body 11 formed of a resilient material such as thermoplastic rubber or the like. The material of the body is preferably of such deformability and resilient quality as to enable the inner side wall 15 thereof to be turned back upon itself.

The device 10 comprises a single, unitary piece formed of such material in a single injection operation (cycle). During fabrication, the molten material flows through a pair of ducts (not shown) which are fluidly connected to the mold in which the body 11 is formed. A pair of protrusions 18, 18' on the body 11 are remnants of the material remaining in such ducts when it set (see FIGS. 1 and 5).

The body 11 has a sleeve 12 with a central passageway 19 and a lip 13 which protrudes generally inward at the discharge end of the passageway forming an aperture 14 which has a diameter less than that of the outer periphery of the leading edge 24 of the aerator but greater than that of a screened opening 25 disposed at the discharge end thereof (see FIG. 5). The sleeve 12 and the lip 13 provide a cushion between the aerator at the tip of the spout and an object impacting thereon which may be fragile and easily chipped such as a piece of china, glassware, a set of false teeth or the like. The thicknesses of the sleeve 12 and of the lip 13 are, by way of example, approximately ⅛ and 1/16th inches, respectively. The outside surface of the body 11 is preferably colored so as to make it attractive to its user.

The device 10 is fitted to the aerator 21 by aligning the sleeve 12 with it so that at least a substantial portion of the leading edge 24 is disposed within the sleeve and then by sliding the sleeve further past this edge until the lip 13 abuts thereagainst. When the lip 13 is contiguous the edge 24, the sleeve 12 extends across the outer surface of the aerator to points thereon which are disposed contiguous the tip of the spout, so that the sloping outer wall 17 of the sleeve 12 abuts the lower edge 26 of the tip of the spout but does not cover the outer periphery thereof (see FIGS. 2 and 4).

The device 10 is readily slipped onto an aerator 21 of the type shown in FIG. 4 in which the outer surface proximate to and bounded by the leading edge at the discharge outlet tapers generally inward toward this edge. In the preferred embodiment illustrated in the drawings, the lower portion of the inner side wall 15 which is directed gradually inward towards the lip 13 has a similar taper in the region proximate to and bounded by the juncture of the lip 13 with the inner side wall 15, so that the shape thereof conforms to the shape of the outer surface of the aerator. Thus the dimensions of the central passageway 19 of the device 10 are chosen so that there is a close fit between it and the aerator.

On the other hand, the outer surface of the upper side wall 17 of the device 10 is inclined generally downward and outward from the longitudinal axis of the aerator 21. By inclining the wall 17 thusly, there is little likelihood that foreign matter, and especially such matter dispersed in a soap solution, will accumulate on the wall 17. Moreover, the device 10 can be readily turned inside out so that the transition zone between the lip 13 and the inner side wall 15 can be exposed for cleaning, with any hardened material accumulated there tending to break away during the process of advancing the lip through the inlet end of the device 10 to turn it inside out.

What is claimed is:

1. A collar for a faucet aerator mounted on the tip of a fixture spout in which the tip forms a shoulder which extends outwardly from the aerator, which comprises:

(a) a short, annular body of elastic material adapted for frictional gripping against an outer surface of the aerator, the body having a passageway extending therethrough and a lip which extends inwardly from a side wall of the collar into the passageway, so that when the collar is positioned on the aerator with the lip abutting against a leading edge of the aerator proximate the discharge outlet thereof, the collar protects fragile objects impacting upon said leading edge;

(b) the side wall being readily slideable across the outer surface of the aerator, so that the collar can be readily sleeved onto the aerator;

(c) the body having an overall length which is substantially less than the greatest dimension of the discharge outlet, the body extending from the lip to the inlet end of the collar, the thickness of the lip in a direction parallel to the longitudinal axis of the passageway being substantially less than the thickness of the side wall of the body in a cross-section thereof perpendicular to said axis in which an outer edge proximate the inlet end lies; the inner surface of the side wall tapering inwardly in the region thereof proximate to the lip, so that the inner surface of the side wall conforms to the shape of the outer surface of the aerator contiguous with said region, thereby enhancing the ability of the collar to grip the outer surface of the aerator; and (d) the body having an upper wall extending from said outer edge inwardly, the upper wall and the outer edge being disposed approximately symmetrically about the longitudinal axis of the passageway, the collar and the aerator being removable from the tip of the fixture spout as one unit without changing the position of the collar with respect to the aerator, the upper wall being adapted to abut said shoulder without covering the periphery of the fixture spout, thereby enabling the short body of the collar to maintain a position in which the longitudinal axes of the passageway and of the aerator are aligned approximately parallel to each other, the abutment of the upper wall with said shoulder tending to prevent any part of the lip, when hit by an object which is acted upon by an upwardly directed force, from slipping sideways so as to expose the leading edge of the aerator proximate its discharge outlet.

2. A collar for a faucet aerator according to claim 1 wherein the body of the collar is further characterized as being formed of a deformable, resilient material, so that the collar can be turned inside out to expose the inner surface of the side wall to facilitate cleaning.

3. A collar for a faucet aerator mounted on the tip of a fixture spout, which comprises:

(a) a short body of elastic, resilient material having a passageway extending therethrough, a side wall of the passageway being adapted for frictional gripping against an outer surface of the aerator, the overall length of the collar in a direction parallel to the longitudinal axis of the passageway being substantially less than the greatest dimension of the discharge outlet of the aerator;

(b) one end of the collar having a lip which extends inwardly from the side wall into the passageway, so that when the collar is positioned on the aerator with the lip abutting against a leading edge of the aerator proximate the discharge outlet thereof, the collar protects fragile objects impacting upon said leading edge; and (c) the thickness of the lip in a direction parallel to the longitudinal axis of the passageway being substantially less than the thickness of a portion of the side wall above the juncture thereof with the lip; the inner surface of the side wall tapering inwardly in the region thereof proximate to and bounded by said juncture, so that the inner surface of the side wall conforms to the shape of the outer surface of the aerator contiguous with said region; the outer surface of the side wall sloping outwardly and upwardly from the lip to an outer edge disposed downwardly of the inlet end of the collar when the collar is mounted on the aerator, the collar presenting a wedge-like shape, the thickest part of the wedge-like shape being disposed distal the discharge outlet, the collar tends to deflect an object which does actually strike the collar from below downwardly, away from the fixture spout but at the same time takes up only slightly more space at the discharge end of the aerator than said discharge end itself.

* * * * *